US006880956B2

(12) United States Patent
Zhang

(10) Patent No.: US 6,880,956 B2
(45) Date of Patent: Apr. 19, 2005

(54) LIGHT SOURCE WITH HEAT TRANSFER ARRANGEMENT

(75) Inventor: Long Bao Zhang, Anaheim, CA (US)

(73) Assignee: A L Lightech, Inc., Anaheim, CA (US)

( * ) Notice: Subject to any disclaimer, the term of this patent is extended or adjusted under 35 U.S.C. 154(b) by 0 days.

(21) Appl. No.: 10/633,051

(22) Filed: Jul. 31, 2003

(65) Prior Publication Data

US 2005/0024875 A1 Feb. 3, 2005

(51) Int. Cl.[7] ..... F21V 29/00
(52) U.S. Cl. ..... 362/264; 362/294; 362/373
(58) Field of Search ..... 362/263, 264, 362/373, 294

(56) References Cited

U.S. PATENT DOCUMENTS 3,560,787 A * 2/1971 Clay et al. ..... 313/112
3,651,358 A * 3/1972 Troue ..... 313/12
3,983,385 A * 9/1976 Troue ..... 422/186.3
3,989,102 A * 11/1976 Jaster et al. ..... 165/104.31
6,087,764 A * 7/2000 Matei ..... 313/22

* cited by examiner

*Primary Examiner*—Thomas M Sember
(74) *Attorney, Agent, or Firm*—Raymond Y. Chan; David and Raymond

(57) ABSTRACT

A light source includes a light head and a heat transfer arrangement. The light head includes a tubular supporting frame, which has an interior space, and a luminary unit provided on the supporting frame. The heat transfer arrangement, for dissipating heat generated from the light head, includes a heat sink and a heat conductor having a sealed chamber, which has a first portion in the supporting frame and a second portion extended to the heat sink, and a cooling agent contained in the sealed chamber of the heat conductor, wherein the cooling agent is capable of being vaporized by the heat of the luminary unit and condensed by said heat sink so as to substantially enable the heat to flow from the luminary unit towards the heat sink.

29 Claims, 6 Drawing Sheets

LIGHT SOURCE WITH HEAT TRANSFER ARRANGEMENT

BACKGROUND OF THE PRESENT INVENTION

1. Field of Invention

The present invention relates to a light source arrangement, and more particularly to a light source with a heat transfer arrangement which comprises a cooling agent contained in an air-sealed chamber for substantially dissipating the heat from the light source through the phase equilibrium process of the cooling agent.

2. Description of Related Arts

Nowadays, the most common light sources for illumination are filament lamp bulb and LED lighting. Due to the remarkable features of low power consumption and instant light emission, LED lighting is specially adapted to be utilized in many electrical appliances, such as the power on-off signal light and instructional signal light of electric equipment, indicating light of electronic clock, and etc. . . .

Due to the technology of LED, the LED, nowadays, not only has excellent properties of low power consumption and instant light emission but also provides a relatively high light intensity and lighting emission angle of the LED such that the LED becomes one of the common lighting apparatus applied in some specific area such as traffic light, signboard light, vehicle brake light and signal light, and airport guiding lighting.

However, when a plurality of light sources consumes electricity at the same time, the heat generated from the light sources may cause a short circuit. In other words, the problem of overheat is one of the common drawbacks of the conventional light sources. In the applicant's another invention, in order to prevent the problem of overheating, the light source usually employs a heat sink directly contacting with the light source to dissipate the heat therefrom by means of conduction. Accordingly, the heat sink is generally made of thermal conducting material, such as copper or aluminum, such that the heat generated from the light source will transfer to the heat sink and dissipate to the surroundings.

However, the heat sink and the light source is in an integral solid connection, the heat from the light source transferred from the light source to the heat sink is still in limited speed. When the temperature of the luminary element reaches 100° C., the illumination and life span thereof will decrease accordingly. The luminary element will even be burnt out when its temperature rises to about 120° C.

Furthermore, when a large number of the light sources are utilized to form a huge signboard, the overall weight of the signboard will be highly increased by the heat sinks of the light sources. In other words, the supporting frame must be rigid enough to support the heavy signboard having hundreds of heat sinks built-in with the light sources.

SUMMARY OF THE PRESENT INVENTION

A main object of the present invention is to provide a light source with a heat transfer arrangement which comprises a cooling agent contained in a sealed chamber for substantially dissipating the heat from the light source through the phase equilibrium process of the cooling agent.

Another object of the present invention is to provide a light source with a heat transfer arrangement, wherein the cooling agent has a high heat conductivity to quickly and effectively transfer the heat away from the light source to the heat sink.

Another object of the present invention is to provide a light source with a heat transfer arrangement, wherein the heat transfer of the light source is a process of evaporation and condensation of the cooling a gent. In other words, the heat from the light source vaporizes the cooling agent within the sealed chamber while the cooling agent is condensed by a heat sink. Therefore, during the phase equilibrium process of the cooling agent, the heat can be more efficiently transferred from the light source to the heat sink.

Another object of the present invention is to provide a light source with a heat transfer arrangement, wherein the heat sink can be located apart from the light source so that the weight of the light source can be substantially reduced so as to enhance the practical use of the light source.

Accordingly, in order to accomplish the above objects, the present invention provides a light source, comprising:

- a light head, comprising:
- a tubular supporting frame having an interior sp ace and a peripheral surface; and
- a luminary unit comprising a circuit for electrically connecting a power source and at least a luminary element electrically connected to the circuit for emitting light; and
- a heat transfer arrangement for dissipating heat generated from the light head, comprising:
- a heat sink;
- a heat conductor having a sealed chamber which has a first portion positioned in the interior space of the supporting frame and a second portion extended to the heat sink; and
- a cooling agent contained in the sealed chamber of the heat conductor, wherein the cooling agent is capable of being vaporized by the heat generated from the luminary unit and condensed by the heat sink so as to substantially enable the heat to flow from the luminary unit towards the heat sink.

These and other objectives, features, and advantages of the present invention will become apparent from the following detailed description, the accompanying drawings, and the appended claims.

DETAILED DESCRIPTION OF THE PREFERRED EMBODIMENTS

Figure 1:
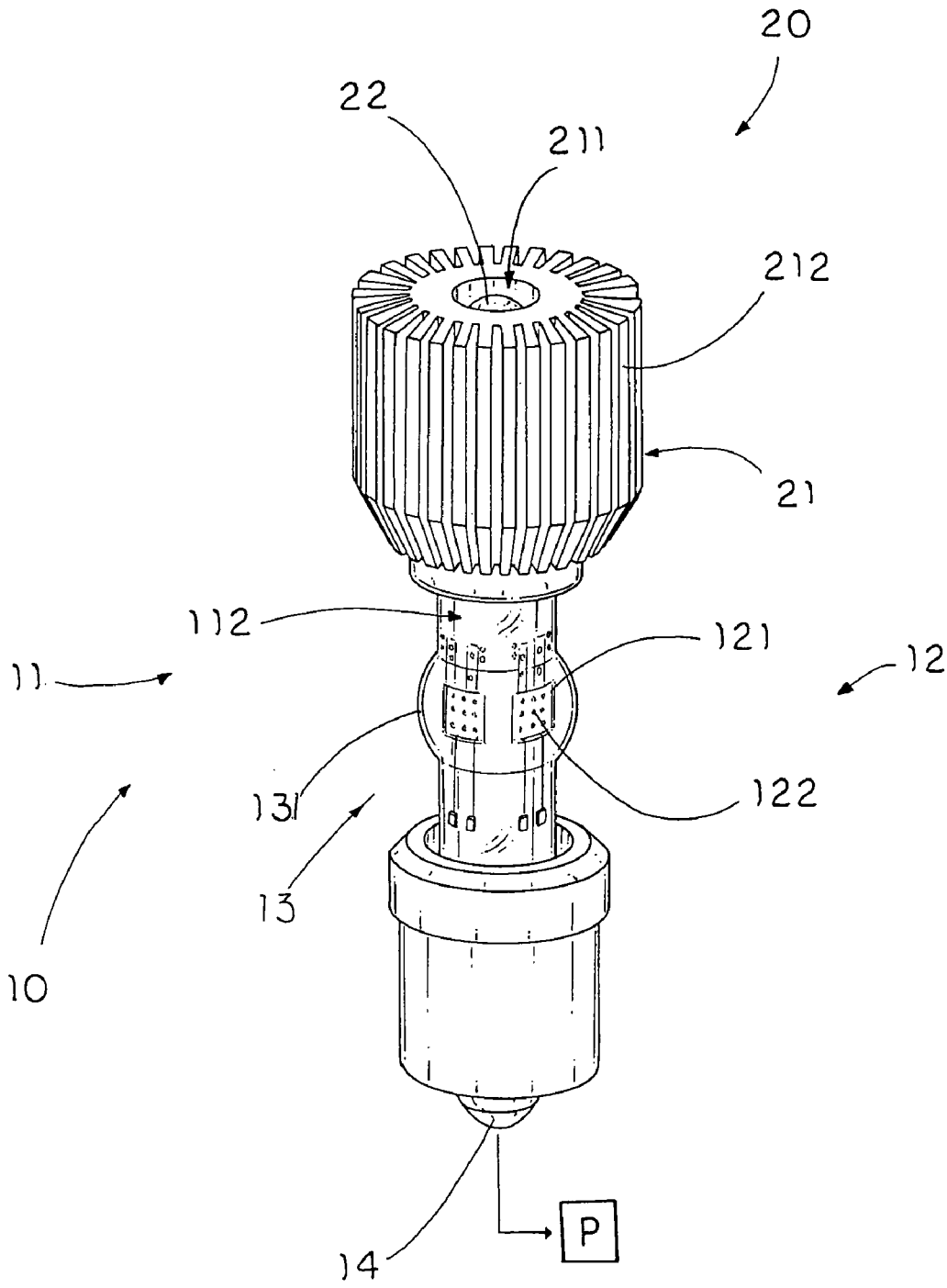
FIG. 1 is an exploded perspective view of a light source with a heat transfer arrangement according to a first preferred embodiment of the present invention.

Referring to FIG. 1 of the drawings, a light source according to a first preferred embodiment of the present invention is illustrated, wherein the light source comprises a light head 10 and a heat transfer arrangement 20 for dissipating heat generated from the light head 10.

The light head 10 comprises a tubular supporting frame 11 having an interior space 111 and a peripheral surface 112, and a luminary unit 12 comprising a circuit 121 provided on the peripheral surface 112 of the supporting frame 11 for electrically connecting a power source P, and at least a luminary element 122 electrically connected to the circuit 121 for emitting light.

The heat transfer arrangement 20 comprises a heat sink 21, a heat conductor 22 having a sealed chamber 221, and a cooling agent 23 contained in the sealed chamber 221. The sealed chamber has a first portion 222 positioned in the interior space 111 of the supporting frame 11 and a second portion 223 extended to the heat sink 21. According to the first preferred embodiment of the present invention, the first portion 222 is an end portion of the heat conductor 22 and the second portion 223 is an opposite end portion of the heat conductor 22. Accordingly, the cooling agent 23 is capable of being vaporized by the heat generated from the luminary unit 12 and condensed by the heat sink 21 so as to substantially transfer the heat flowing from the luminary unit 12 towards the heat sink 21.

According to the preferred embodiment, the supporting frame 11 is constructed as an elongated hollow member to define the interior space 111 wherein the supporting frame 11 is made of material having high thermal conductivity such as copper or aluminum. Accordingly, the supporting frame 11 can be formed to have a circular cross section, triangular cross section, rectangular cross section, or polygonal cross section, wherein the first portion 222 of the heat conductor 22 is fittedly inserted into the supporting frame 11 in such a manner that the first portion 222 of the heat conductor 22 must be in contact with a peripheral wall 110 having the peripheral surface 112 of the supporting frame 11.

Figure 2A:
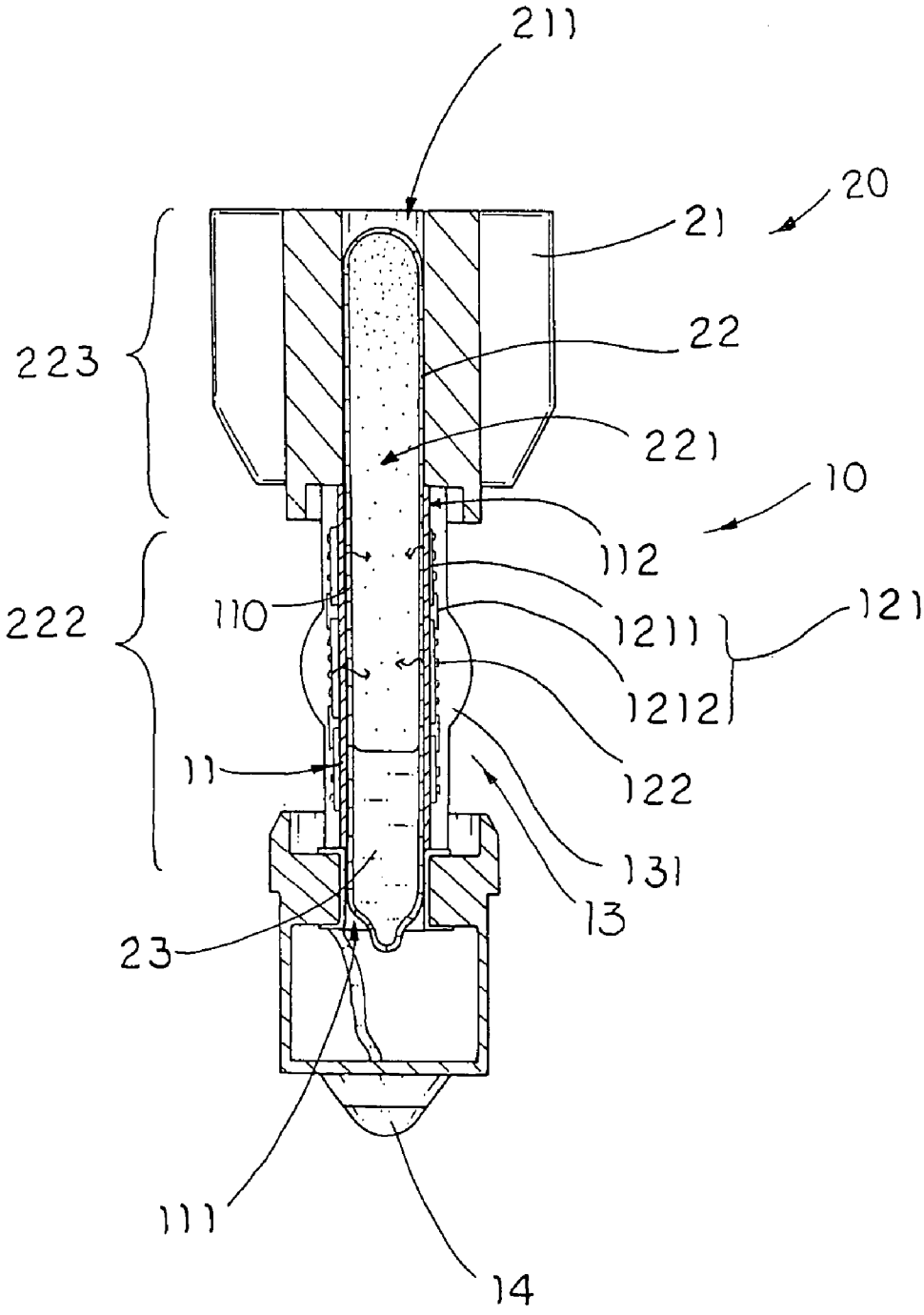
FIG. 2A is a sectional view of the light source with the heat transfer arrangement according to the above first preferred embodiment of the present invention.

As shown in FIG. 2A, the luminary element 122 is mounted on the peripheral surface 112 of the supporting frame 11 to electrically connect with the circuit 121. According to the preferred embodiment, the luminary element 122 is a double bonded diode has two terminal electrodes electrically connected to the circuit 121 in such a manner that the light is emitted by the luminary element 122 when the two terminal electrodes are electrified. Practically, different kinds of luminary elements 122 can provide different colors of light such as red, blue or green. It is worth to mention that the luminary element 122 can be the single bonded diode having a terminal electrode electrically connected to the supporting frame 11 while another terminal electrode electrically connected to the circuit 121.

As shown in FIG. 2A, the circuit 121 comprises an elastic board layer 1211 firmly attached to the peripheral surface 112 of the supporting frame 11, e.g. by glue, and a circuit arrangement 1212 formed on the board layer 1211 to electrically connect to the luminary element 122.

According to the advance technology at the time of the present invention, the circuit 121 is preferred to be directly imprinted on the peripheral surface 112 of the supporting frame 11 so that the luminary element 122 is mounted on the peripheral surface 112 of the supporting frame 11 to electrically connect with the circuit 121.

For protecting the luminary element 122, the light head 10 further comprises a transparent light shelter 13 sealedly mounted on the peripheral surface 112 of the supporting frame 11 to sealedly protect the circuit 121 and the luminary element 122. The light shelter 13 is preferably made of resin or other similar material having high thermo-resistance ability that is molded to integrally enclose the peripheral surface 112 of the supporting frame 11.

The light shelter 13 has a light projecting portion provide on the supporting frame 11 at a position aligning with the luminary element 122 to function as a lens 131 in such a manner that the light produced by the luminary element 122 is arranged to pass through the light projecting portion of the light shelter 13 to outside. In other words, the light projecting portion of the light shelter 13 having a spherical shaped is adapted to amplify the light from the luminary element 122 so as to enhance the light intensity of the light head 10. Preferably, the luminary element 122 is positioned close to a focus point of the light projecting portion of the light shelter to evenly distribute the light therethrough.

The heat sink 21, which is made of material having high thermal conductivity, has a conductor socket 211 for the second portion 223 of the heat conductor 22 to slidably insert thereinto. The heat sink 21, which has a plurality of heat dissipating blades 212, is arranged to cool down the cooling agent 23, which is evaporated in vapor form by the heat generated by the light head 10, in the first portion of the heat conductor 22, so as to condense the cooling agent 23 within the sealed chamber 221 from its vapor form to its liquid form.

As shown in FIG. 2A, the heat conductor 22, which is made of high thermal conductivity, is an elongated tubular member having two closed ends and concealing the sealed chamber 221 therein. The first portion 222 of the heat conductor 22 having a corresponding cross sectional is fittedly inserted into the supporting frame 11 to substantially increase a contacting surface area between the light head 10 and the heat conductor 22 for further enhancing the heat transfer from the light head 10 to the heat sink 21. Accordingly, the first portion 222 of the heat conductor 22 preferably has a non-circular cross sectional to prevent an unwanted rotational movement of the light head 10 with respect to the heat conductor 22 when the first portion 222 of the heat conductor 22 is engaged with the light head 10.

The cooling agent 23 should be a liquid having lower vaporization temperature, e.g. 60° C.–70° C., wherein the cooling agent 23 is concealed within the sealed chamber 221 of the heat conductor 22. When the light head 10 is utilized over a period of time, the luminary element 122 produces heat and the temperature within the sealed chamber 221 is increased.

When the temperature of second portion 23 of the sealed chamber 221 of the heat conductor 22 that is received in the light head 10 reaches or is higher than the vaporization temperature of the cooling agent 23, the cooling agent 23 starts to be vaporized at the second portion 23. According to the theory of heat transfer, heat flows from a higher temperature region to a lower temperature region. Therefore, the cooling agent 23 in vapor form flows to the first portion 22 of sealed chamber 221 of the heat conductor 22 that is extended to the heat sink 23 and a temperature lower than the temperature of the light head 10. Then, the cooling agent 23 is cooled down by the heat sink 21 to condense back to its liquid form. Accordingly, the heat from the light head 10 is more efficiently transferred to the heat sink 21 through the phase equilibrium process of the cooling agent 23. In addition, the cooling agent 23 will not vanish during the vaporization process thereof because the cooling agent 23 is sealedly contained within the sealed chamber 221 of the heat conductor 22, so as to prolong the service life span thereof.

It is worth to mention that the cooling agent 23 has higher heat sensitivity than metal so that it can quickly and effectively transfer the heat from the light head 10 to dissipate from the heat sink 21 such that the surface of the light shelter 13 can be maintained at a temperature that the operator is able to touch without burning his or her hand even though the light head 10 is utilized for a long period of time.

Figure 2B:
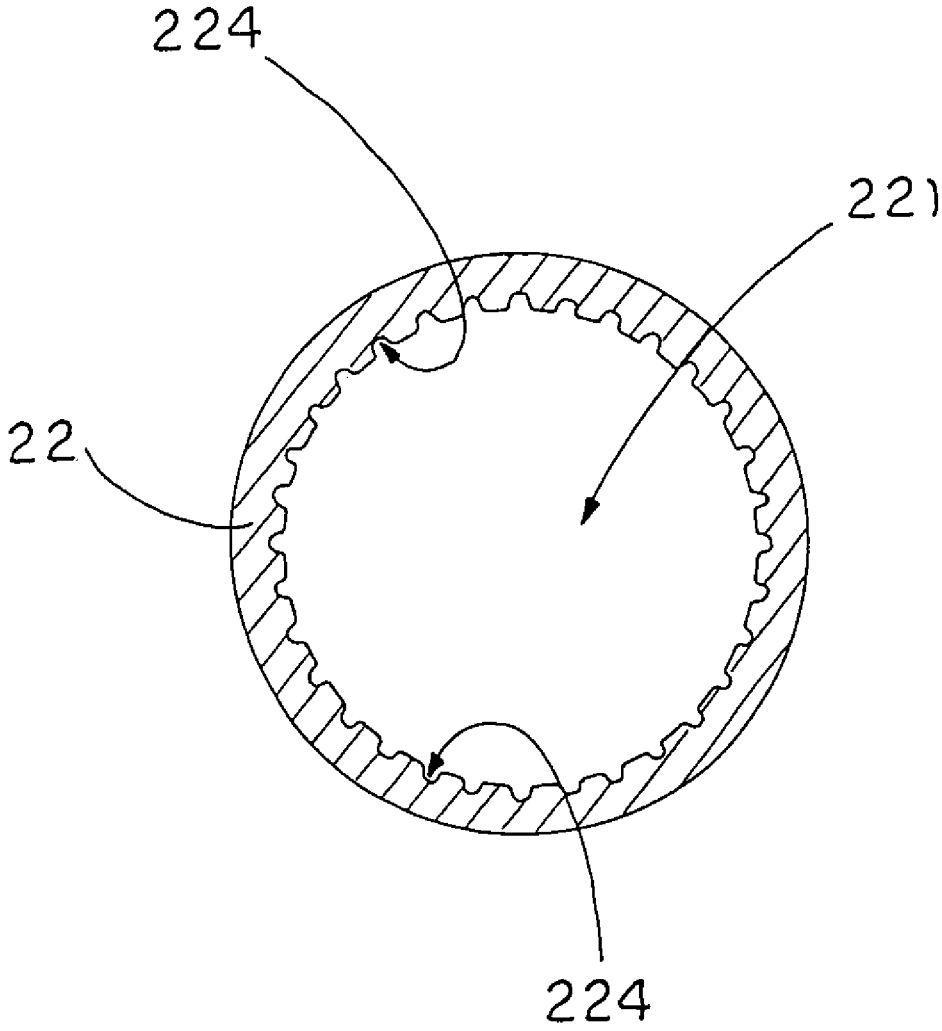
FIG. 2B is a sectional view of the heat conductor of the light source with the heat transfer arrangement according to the above first preferred embodiment of the present invention.

As shown in FIG. 2B, the heat conductor 22 further has a plurality of conduction channels 224 spacedly and longitudinally provided on a surrounding wall of the sealed chamber 221, i.e. an inner surface of the heat conductor 22, wherein the conduction channels 224 are extended from the first portion 222 of the heat conductor 22 to the second portion 223 thereof to guide the cooling agent 23 flowing between the heat sink 21 and the light head 10. According to the preferred embodiment, the conduction channels 224 can be capillary grooves of any cross section, such as semi-circular, triangular, or rectangular, parallelly and longitudinally indented along the inner surface of the heat conductor 22.

Accordingly, the cooling cycle of the cooling agent is that the cooling agent 23 will be vaporized by the heat of the light head 10 and cooled down by the heat sink 21 to condense the cooling agent 23 back to its liquid form. The cooling agent 23 is guided to flow back towards the light head 10 along the conduction channels 224 to enhance the cooling cycle. In other words, when the vaporized cooling agent 23 is cooled down in the second portion 223 to liquid form through the heat sink 21, the conduction channels 224 are arranged to guide the cooling agent 23 back to its original position. In addition, the conduction channels 224 also substantially increase the contacting area between the heat conductor 22 and the cooling agent 23 so as to enhance the cooling effect of the light source of the present invention.

As shown in FIG. 2A, the heat sink 21 is embodied to be positioned on top of the supporting frame 11 such that a top portion of the heat conductor 22 embodies as the second portion 223 thereof to mount with the heat sink 21 while a bottom portion of the heat conductor 22 embodies as the first portion 222 thereof to mount with the supporting frame 11. Therefore, when the heat vaporizes the cooling agent 23 to flow upward, the cooling agent 23 is then condensed by the heat sink 21 to drop down to the bottom portion of the sealed chamber 221 to re-contact with the light head 10. Therefore, the heat sink 21 is preferred to mount on the supporting frame 11 to enhance the phase equilibrium process of the cooling agent 23.

According to the preferred embodiment, ether $(C_2H_5)_2O$ or ethanol can be used as the cooling agent 23 which is in liquid form ether at room temperature and has a vaporization temperature about 60° C. or less. The amount of cooling agent 23 to be used is preferred to be about 30% of the volume of the sealed chamber 221. For example, when an interior diameter of the sealed chamber 221 of the heat conductor 22 is designed to be 3–4 mm to form a total volume of about 3–6 ml for the sealed chamber 221 and 1–2 ml of cooling agent 23 is received in the sealed chamber 221, such heat transfer arrangement 20 can support the heat dissipation of the light head 10 designed to have a power of 18 W, such as 3V and 6 A, to either produce red light with 200 lumen or more, i.e. about the illumination of a 55 W Halogen lamp through a red light filter, or blue light with 80 or more lumen. However, a 55 W Halogen lamp can merely produce a 30 lumen blue light through a blue light filter.

According to the preferred embodiment, the light source of the present invention is embodied to function as a light bulb for detachably mounting on a light bulb socket so as to electrically connect to the power source. The light head 10 thus comprises an electric adapter 14 formed at the supporting frame 11 to electrically connect to the luminary unit 12 wherein the electrical adapter 14 is a plug for plugging into the light bulb socket and is constructed as a universal adapter for electrically connecting with the power source P via the light bulb socket.

As shown in FIG. 2A, the light source of the present invention is embodied to vertically mount on the light bulb socket that, generally, the liquid form cooling agent 23 is contained at the bottom portion of the sealed chamber 221 of the heat conductor 22 to communicate with luminary unit 12 on the supporting frame 11. It is worth to mention that the light source can be mounted to the light bulb socket at a horizontal position since the liquid form cooling agent 23 would sink at the lower portion of the sealed chamber 221. In other words, the phase equilibrium process of the cooling agent 23 can occur due to the heat of the light head 10 in accordance with any oriental position of the supporting frame 11 with respect to the heat sink 21.

Figure 3:
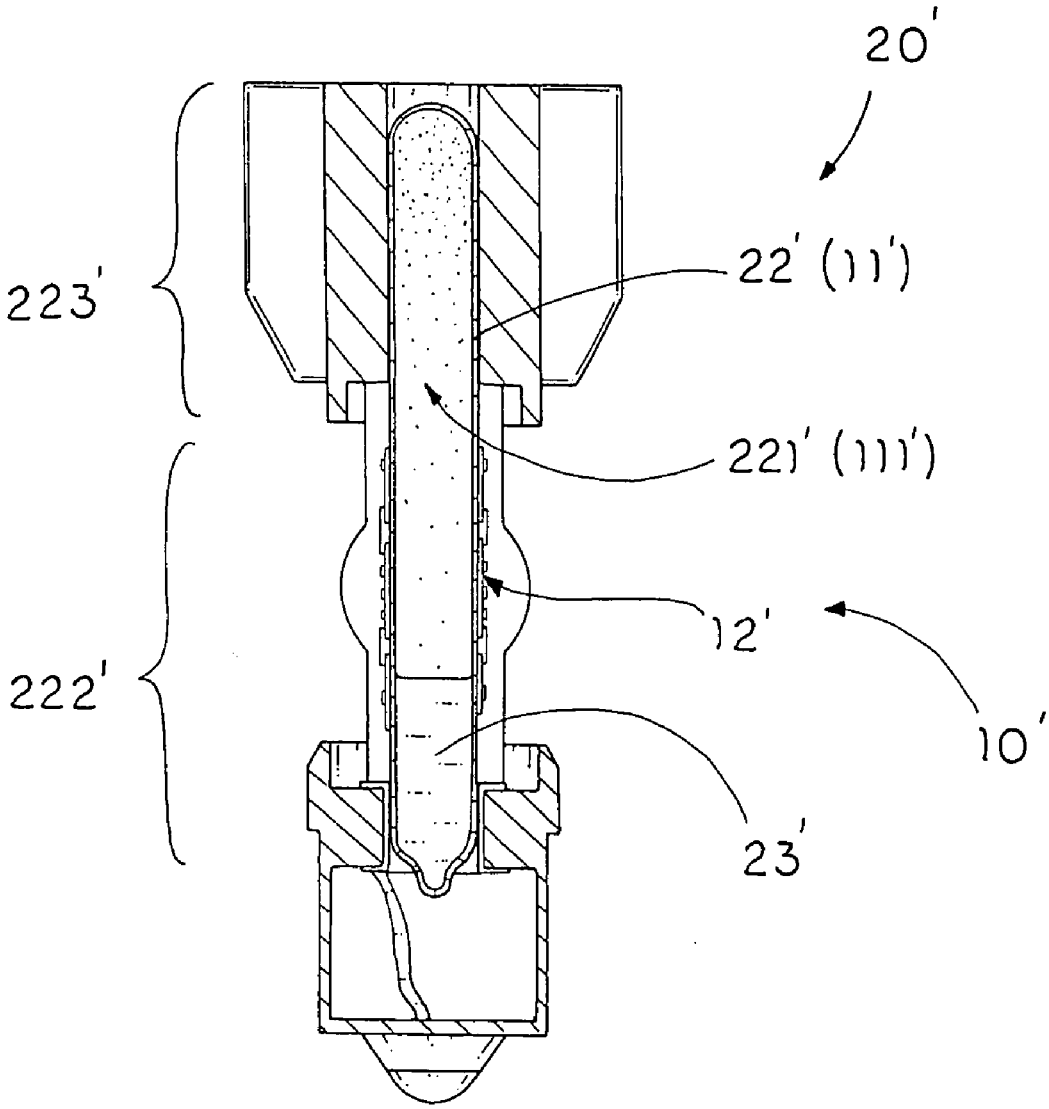
FIG. 3 illustrates an alternative mode of the heat conductor of the heat transfer arrangement according to the above first preferred embodiment of the present invention.

FIG. 3 illustrates an alternative mode of the heat conductor 22' which is constructed by the supporting frame 11' wherein the supporting frame 11' is formed as an elongated tubular member to form the interior space 111' as the sealed chamber 221' so as to contain the cooling agent 23' within the interior space 111' of the supporting frame 11". In other words, an upper portion of the supporting frame 11' functions as the second portion 223' of the heat conductor 22' to mount with the heat sink 21' while a lower portion of the supporting frame 11' function as the first portion 222' of the heat conductor 22', wherein the luminary unit 12' is provided at the bottom portion of the supporting frame 11' to communicate with the cooling agent 23' through the heat transfer.

Figure 4:
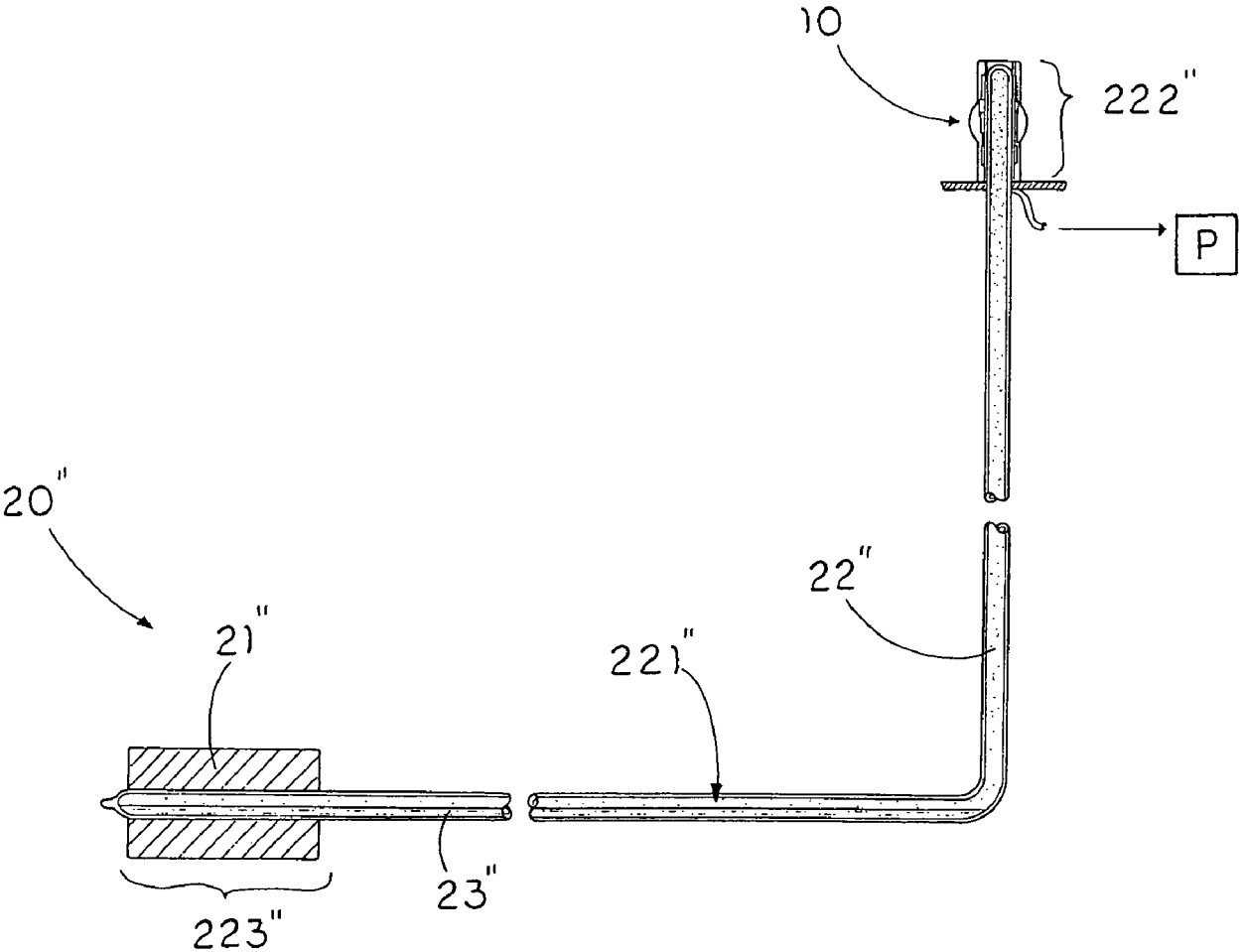
FIG. 4 is a sectional view of a light source with a heat transfer arrangement according to a second preferred embodiment of the present invention.

As shown in FIG. 4, a light source of a second embodiment is illustrated which is another alternative mode of the first preferred embodiment of the present invention, wherein the light source has the same structural components of the first embodiment thereof. The heat conductor 22" is an elongated tubular member having the first portion 222" extended from the light head 10 and the second portion 223" mounted to the heat sink 21", wherein the heat sink 21" is positioned apart from the light head 10. It is worth to mention that the light head 10 is capable of communicating with the heat sink 21" through the heat conductor 22" so as to transfer the heat from the light head 10 to the heat sink 21" through the phase equilibrium process of the cooling agent 23".

Due to the high heat sensitivity of the cooling agent 23", the cooling agent 23" is vaporized by the heat from the light head 10" in the first portion 222" of the heat conductor 22" and is condensed by the heat sink 21" at the second portion 223" of the heat conductor 22". In other words, even the light head 10 is positioned apart from the heat sink 21", the heat from the light head 10 can be quickly and effectively transferred to the heat sink 21" through the heat conductor 22", as shown in FIG. 4.

Figure 5:
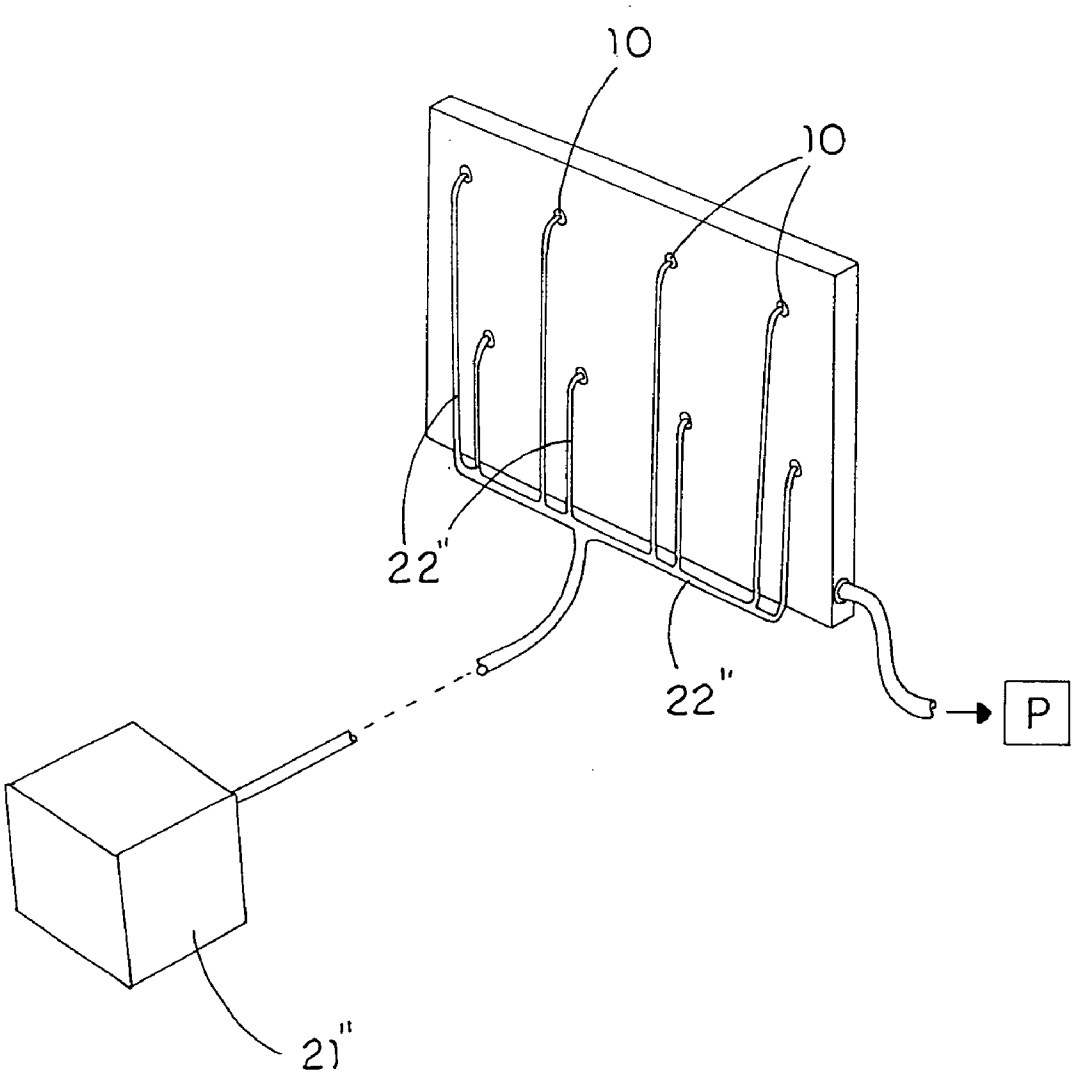
FIG. 5 illustrates an application of the light source with the heat transfer arrangement according to the above second preferred embodiment of the present invention.

The light source of the second embodiment is specially designed for commercial use such as using in a billboard. As shown in FIG. 5, a plurality of light heads 10 are supported on a signboard to electrically connect with the power source wherein the heat conductor 22" is extended from each of the light heads 10 to mount to the heat sink 21" in such a manner that the heat from the light heads 10 can be substantially transferred to the heat sink 21" through the heat conductor 22". Therefore, the heat from the light heads 10 can be effectively dissipated by using one single big heat sink 21" installed in an appropriate area. It is appreciated that the heat sink 21" would be constructed to be a powerful heat sink for commercial use such as fluid cooling system so as to cool down the cooling agents 23" within the heat conductors 22" to dissipate the heat transferred from the light heads 10".

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure form such principles. Therefore, this invention includes all modifications encompassed within the spirit and scope of the following claims.

What is claimed is:

1. A light source, comprising:

a light head, comprising:

a tubular supporting frame having an interior space and a peripheral surface; and a luminary unit comprising one or more luminary elements provided on said peripheral surface for emitting light; and a heat transfer arrangement for dissipating heat generated from said light head, comprising:

a heat sink;

a heat conductor having a sealed chamber which has a first portion positioned in said interior space of the supporting frame and a second portion extended to said heat sink; and a cooling agent contained in said sealed chamber of said heat conductor, wherein said cooling agent is capable of being vaporized by said heat generated from said luminary unit and condensed by said heat sink so as to enable said heat to flow from said luminary unit towards said heat sink.

2. A light source, as recited in claim 1, wherein said heat conductor comprises an elongated tubular member concealing said sealed chamber therein to contain said cooling agent within said sealed chamber of said heat conductor.

3. A light source, as recited in claim 2, wherein said cooling agent is a liquid having a vaporization temperature lower than 100° C. and higher than a room temperature.

4. A light source, as recited in claim 3, wherein said heat sink is positioned above of said supporting frame such that an upper portion of said heat conductor functioned as said second portion thereof to mount with said heat sink while a lower portion of said heat conductor functioned as said first portion thereof to couple with said supporting frame.

5. A light source, as recited in claim 4, wherein said heat conductor further has a plurality of conduction channels spacedly provided on a surrounding wall of said sealed chamber, wherein said conduction channels are extended from said first portion of said heat conductor to said second portion thereof.

6. A light source, as recited in claim 5, further comprising an electric adapter coupled with said light head and electrically connected to said luminary unit for connection with a conventional light bulb connector for electrically connecting with said power source via said light bulb connector.

7. A light source, as recited in claim 4, further comprising an electric adapter coupled with said light head and electrically connected to said luminary unit for connection with a conventional light bulb connector for electrically connecting with said power source via said light bulb connector.

8. A light source, as recited in claim 3, wherein said heat conductor further has a plurality of conduction channels spacedly provided on a surrounding wall of said sealed chamber, wherein said conduction channels are extended from said first portion of said heat conductor to said second portion thereof.

9. A light source, as recited in claim 3, further comprising an electric adapter coupled with said light head and electrically connected to said luminary unit for connection with a conventional light bulb connector for electrically connecting with said power source via said light bulb connector.

10. A light source, as recited in claim 2, wherein said heat sink is positioned above of said supporting frame such that an upper portion of said heat conductor functioned as said second portion thereof to mount with said heat sink while a lower portion of said heat conductor functioned as said first portion thereof to couple with said supporting frame.

11. A light source, as recited in claim 2, wherein said heat conductor further has a plurality of conduction channels spacedly provided on a surrounding wall of said sealed chamber, wherein said conduction channels are extended from said first portion of said heat conductor to said second portion thereof.

12. A light source, as recited in claim 1, wherein said cooling agent is a liquid having a vaporization temperature lower than 100° C. and higher than a room temperature.

13. A light source, as recited in claim 1, wherein said heat sink is positioned above of said supporting frame such that an upper portion of said heat conductor functioned as said second portion thereof to mount with said heat sink while a lower portion of said heat conductor functioned as said first portion thereof to couple with said supporting frame.

14. A light source, as recited in claim 1, wherein said heat conductor further has a plurality of conduction channels spacedly provided on a surrounding wall of said sealed chamber, wherein said conduction channels are extended from said first portion of said heat conductor to said second portion thereof.

15. A light source, as recited in claim 1, further comprising an electric adapter coupled with said light head and electrically connected to said luminary unit for connection with a conventional light bulb connector for electrically connecting with said power source via said light bulb connector.

16. A light source, as recited in claim 1, wherein said supporting frame integrally constructed as said heat conductor that said supporting frame is made as an elongated tubular member to form said interior space as said sealed chamber so as to contain said cooling agent within said interior space of said supporting frame.

17. A light source, as recited in claim 16, wherein an upper portion of said supporting frame functioned as said second portion of said heat conductor to mount with said heat sink while a lower portion of said supporting frame functioned as said first portion of said heat conductor, wherein said luminary unit is provided at said lower portion of said supporting frame to communicate with said cooling agent within said sealed chamber.

18. A light source, as recited in claim 17, wherein said cooling agent is a liquid having a vaporization temperature lower than 100° C. and higher than a room temperature.

19. A light source, as recited in claim 18, wherein said heat conductor further has a plurality of conduction channels spacedly provided on a surrounding wall of said sealed chamber, wherein said conduction channels are extended from said first portion of said heat conductor to said second portion thereof.

20. A light source, as recited in claim 19, further comprising an electric adapter coupled with said light head and electrically connected to said luminary unit for connection with a conventional light bulb connector for electrically connecting with said power source via said light bulb connector.

21. A light source, as recited in claim 17, wherein said heat conductor further has a plurality of conduction channels spacedly provided on a surrounding wall of said sealed chamber, wherein said conduction channels are extended from said first portion of said heat conductor to said second portion thereof.

22. A light source, as recited in claim 16, further comprising an electric adapter coupled with said light head and electrically connected to said luminary unit for connection with a conventional light bulb connector for electrically connecting with said power source via said light bulb connector.

23. A light source, comprising:

one or more light heads for illumination; and a heat transfer arrangement for dissipating heat generated from said light heads, comprising:

a heat sink positioning apart from said light heads;

a heat conductor having a sealed chamber which has one or more first portions extended light heads respectively, a second portion extended to said heat sink and a plurality of conduction channels spacedly provided on a surrounding wall of the sealed chamber and extended from said first portions to said second portion of said heat conductor; and a cooling agent contained in said sealed chamber of said heat conductor for flowing between said heat sink and said light heads therethrough, wherein said cooling agent is capable of being vaporized by heat generated from said light heads and condensed by said heat sink so as to enable said heat to flow from said light heads towards said heat sink.

24. A light source, comprising:

one or more light heads for illumination; and a heat transfer arrangement for dissipating heat generated from said light heads, comprising:

a heat sink positioning apart from said light heads;

a heat conductor comprising an elongated tubular member concealing a sealed chamber therein, wherein said sealed chamber has one or more first portions extended light heads respectively, a second portion extended to said heat sink and a plurality of conduction channels spacedly provided on a surrounding wall of the sealed chamber and extended from said first portions to said second portion of said heat conductor; and a cooling agent contained in said sealed chamber of said heat conductor for flowing between said heat sink and said light heads therethrough, wherein said cooling agent is capable of being vaporized by heat generated from said light heads and condensed by said heat sink so as to enable said heat to flow from said light heads towards said heat sink.

25. A light source, as recited in claim 24, wherein each of said light heads comprises a tubular supporting frame having a peripheral surface and a luminary unit comprising one or more luminary elements provided on said peripheral surface connected to a power source for emitting light.

26. A light source, comprising:

one or more light heads for illumination; and a heat transfer arrangement for dissipating heat generated from said light heads, comprising:

a heat sink positioning apart from said light heads;

a heat conductor comprising an elongated tubular member concealing a sealed chamber therein, wherein said sealed chamber has one or more first portions extended light heads respectively, a second portion extended to said heat sink and a plurality of conduction channels spacedly provided on a surrounding wall of the sealed chamber and extended from said first portions to said second portion of said heat conductor; and a cooling agent contained in said sealed chamber of said heat conductor for flowing between said heat sink and said light heads therethrough, wherein said cooling agent is a liquid having a vaporization temperature lower than 100° C. and higher than a room temperature and is capable of being vaporized by heat generated from said light heads and condensed by said heat sink so as to enable said heat to flow from said light heads towards said heat sink.

27. A light source, as recited in claim 26, wherein each of said light heads comprises a tubular supporting frame having a peripheral surface and a luminary unit comprising one or more luminary elements provided on said peripheral surface connected to a power source for emitting light.

28. A light source, comprising:

one or more light heads for illumination, each of said light heads comprises a tubular supporting frame having a peripheral surface and a luminary unit comprising one or more luminary elements provided on said peripheral surface connected to a power source for emitting light; and a heat transfer arrangement for dissipating heat generated from said light heads, comprising:

a heat sink positioning apart from said light heads;

a heat conductor having a sealed chamber which has one or more first portions extended light heads respectively and a second portion extended to said heat sink; and a cooling agent contained in said sealed chamber of said heat conductor, wherein said cooling agent is capable of being vaporized by heat generated from said light heads and condensed by said heat sink so as to enable said heat to flow from said light heads towards said heat sink.

29. A light source, comprising:

one or more light heads for illumination, each of said light heads comprises a tubular supporting frame having a peripheral surface and a luminary unit comprising one or more luminary elements provided on said peripheral surface connected to a power source for emitting light; and a heat transfer arrangement for dissipating heat generated from said light heads, comprising:

a heat sink positioning apart from said light heads;

a heat conductor comprising an elongated tubular member concealing a sealed chamber therein, wherein said sealed chamber has one or more first portions extended light heads respectively and a second portion extended to said heat sink; and a cooling agent contained in said sealed chamber of said heat conductor, wherein said cooling agent is capable of being vaporized by heat generated from said light heads and condensed by said heat sink so as to enable said heat to flow from said light heads towards said heat sink.

* * * * *